US007237278B1

(12) United States Patent
Scott

(10) Patent No.: US 7,237,278 B1
(45) Date of Patent: Jul. 3, 2007

(54) POTTY TRAINING DEVICE WITH MEANS FOR RECORDING AND PLAYING AUDIO CLIPS

(76) Inventor: Dara Scott, 21426 Manor Way, Lexington Park, MD (US) 20653

( * ) Notice: Subject to any disclaimer, the term of this patent is extended or adjusted under 35 U.S.C. 154(b) by 147 days.

(21) Appl. No.: 10/957,958

(22) Filed: Oct. 4, 2004

(51) Int. Cl.
*A47K 17/00* (2006.01)

(52) U.S. Cl. ..... 4/661; 4/902; 4/483

(58) Field of Classification Search ..... 4/486, 4/661, 902, 476, 483
See application file for complete search history.

(56) References Cited

U.S. PATENT DOCUMENTS

| | | | | |
|---|---|---|---|---|
| 2,788,764 | A | 4/1957 | Headlee | |
| 3,364,478 | A | 1/1968 | Waard | |
| 4,174,544 | A | 11/1979 | Furusawa | |
| 4,883,749 | A | 11/1989 | Roberts et al. | |
| 5,008,964 | A | 4/1991 | Dean et al. | |
| 5,518,405 | A | 5/1996 | Aiello | |
| 5,781,939 | A | 7/1998 | Bledsoe | |
| 5,893,178 | A * | 4/1999 | Wosiek | 4/483 |
| 6,038,711 | A | 3/2000 | Clarke | |
| 6,282,732 | B1 | 9/2001 | Krvavica et al. | |
| 6,698,036 | B2 | 3/2004 | Armbruster et al. | |

FOREIGN PATENT DOCUMENTS

| | | |
|---|---|---|
| CH | 00854 | 6/1978 |
| EP | 0914793 | 5/1999 |

* cited by examiner

*Primary Examiner*—Huyen Le
(74) *Attorney, Agent, or Firm*—Michael I Kroll

(57) ABSTRACT

The device 10 is a potty training device having a housing with a pivotal seat 14 positioned over a cavity 16 for receiving the waste material that is discarded by slidably removing the receptacle 18 that forms the base of the bowl-like cavity. The housing also provides shelf 24 or compartment space 20 for storage of items that can be used by the toddler or child 12. Also within the housing are electronic components for recording and playing a musical tune and/or audio clips. A pressure switch 30 positioned under the pivotal seat 14 causes a musical tune or prerecorded audio sequence to be played when the child sits on the pivotal seat 14. The user 12 can selectively record tune or audio clip to be played when the pressure switch 30 is engaged.

13 Claims, 11 Drawing Sheets

POTTY TRAINING DEVICE WITH MEANS FOR RECORDING AND PLAYING AUDIO CLIPS

BACKGROUND OF THE INVENTION

1. Field of the Invention

The present invention relates generally to toilets and, more specifically, to a potty training device. The device is used to familiarize a child or toddler with a conventional toilet. The device is comprised of a housing having a pivotal seat positioned over a cavity for receiving the waste material that is discarded by slidably removing the receptacle that forms the base of the bowl-like cavity. The housing also provides shelf or compartment space for storage of items that can be used by the toddler or child.

Also within the housing are the electronic components for recording and playing a musical tune and/or audio clips. Positioned under the seat is a pressure switch that is designed to react to weight placed thereon. It can be comprised of a compressible elastomeric or polymeric material that is shape retentive having the actual switch concealed therein protecting the child as well as preventing damage from contact with water, which is inevitable during cleaning. The device may also include a switch for engaging and disengaging the pressure switch to prevent the toddler or child from turning the device into a toy. When the pressure switch is engaged a musical tune or prerecorded audio sequence is played for a predetermined period of time or continuously cycled until the switch is opened by the child getting off of the seat. Another audio clip of a typical flushing toilet is activated by depressing a handle situated within reach of the toddler or child.

Additionally incorporated into the potty training device is an audio recording component whereby the user can selectively record another tune or audio clip to be played when the pressure switch is engaged.

2. Description of the Prior Art

There are other potty training devices designed for children. Typical of these is U.S. Pat. No. 2,788,764 issued to Headlee on Apr. 16, 1957.

Another patent was issued to Waard on Jan. 16, 1968 as U.S. Pat. No. 3,364,478. Yet another U.S. Pat. No. 4,174,544 was issued to Furusawa on Nov. 20, 1979 and still yet another was issued on Nov. 28, 1989 to Roberts as U.S. Pat. No. 4,883,749.

Another patent was issued to Dean, et al. on Apr. 23, 1991 as U.S. Pat. No. 5,008,964. Yet another U.S. Pat. No. 5,518,405 was issued to Aiello on May 21, 1996. Another was issued to Bledsoe on Jul. 21, 1998 as U.S. Pat. No. 5,781,939 and still yet another was issued on Mar. 21, 2000 to Clarke as U.S. Pat. No. 6,038,711.

Another patent was issued to Krvavica, et al. on Sep. 4, 2001 as U.S. Pat. No. 6,282,732. Yet another U.S. Pat. No. 6,698,036 was issued to Armbruster, et al. on Mar. 2, 2004. Another was issued to Moser on Jun. 30, 1978 as Swiss Patent No. CH600854 and still yet another was issued on May 12, 1999 to Chai as European Patent Application No. EP 0 914 793.

U.S. Pat. No. 2,788,764

Inventor: Frank Headlee

Issued: Apr. 16, 1957

A portable infant's dry closet which comprises, a pedestal including downwardly and outwardly flaring side walls forming a recessed base having a rearwardly extended portion, a bowl supported upwardly of said pedestal, a hollow housing web extending rearwardly of said base and bowl and upwardly from said base to the upper portion of said bowl, the said housing being in open communication with the recess of said base, a seat pivotally supported at the upper portion of said bowl, a plate member supported in the recess of said base, a music box including a brake supported on said plate member, a brake rod for said music box brake extending through the opening between said housing and the recess of said base, a rocker arm pivotally supported intermediate its length within said housing, one end of said brake rod being operatively connected to said music box brake and the other end of said brake rod being connected to one end of said rocker arm, an upright trip rod within said housing, the lower end of said trip rod being connected to the other end of said rocker arm and the upper end of said trip rod projecting upwardly of said housing adjacent a bottom portion of said seat, and spring means connected between the upper end portion of said trip rod and said bottom portion of said seat tending normally to elevate said trip rod and to tilt said seat upwardly, the arrangement being such that when said seat is occupied said trip rod is depressed whereby to actuate said music box.

U.S. Pat. No. 3,364,478

Inventor: John Dee Waard

Issued: Jan. 16, 1968

A toilet training chair having legs, arms, a back and a seat with an enlarged aperture therethrough comprising a pair of elongated parallel supports fixed on and spaced from the underside of said seat, a bowl having at least two outwardly extending flange portions on opposite sides thereof, pivot means on said flange portions along a common axis, said pivot means engaging with portions of said supports such that the bowl is substantially balanced along said common axis, a light carried by said chair, a battery operated circuit for said light, an actuator member in said circuit whereby in one position said light is inoperative and in another position said light is operative, and said actuator member extending in operative relation to said bowl whereby said actuator member is in the inoperative position when said bowl is empty and said actuator member is in the operative position when weight is added to said bowl to pivot said bowl into said operative position of said actuator member by a portion of said bowl engaging with and moving said portion of said actuator member to light said light.

U.S. Pat. No. 4,174,544

Inventor: Noriko Furusawa

Issued: Nov. 20, 1979

An infant training stool having a bed pan rockably carried therein. A music box is mounted in the base portion of the stool and is normally kept from playing by a biased stopper rod blocking the governor. In a first embodiment, the weight of the infant lowers the stopper rod allowing the music box to play. In the second, the weight of the infant's elimination lowers the internal bed pan lowering the stopper rod thereby allowing the music box to play.

U.S. Pat. No. 4,883,749

Inventor: Freddie R. Roberts, et al.

Issued: Nov. 28, 1989

A toilet training device for rewarding the toilet user when excrement enters or is placed in an excrement container by the toilet user. The toilet training device includes an excrement container having an entrance area and a plurality of infrared light-emitting diodes are sequentially triggered and sequentially emit infrared light substantially intersecting the entrance area. The infrared light is detected at the other end of the entrance area by an infrared light detector that generates an electrical signal in response to detected infrared light. A width pulse counter is connected to the detector and generates a first signal in response to a narrow electrical signal and a second signal in response to a wide electrical signal. The first and second signals are responsive to liquid or solid excrement deposition and generate, through control logic, one of a sight or sound signals or both for rewarding the user of the toilet training device.

U.S. Pat. No. 5,008,964

Inventor: Janet C. Dean, et al.

Issued: Apr. 23, 1991

A potty chair for toilet training children and of the type having an automatic speech and tune producing capability. The tune generating circuit plays a tune when a child first sits on the potty chair seat. A moisture sensing circuit detects the introduction of bodily waste into the waste receptacle: which it communicates to the speech generating circuit, causing it to play a voice message. In addition, a changeable data storage circuit determines the tune and voice messages that are produced. Other features of the invention include control of the tune and speech volume and power conditioning for the electronic circuits.

U.S. Pat. No. 5,518,405

Inventor: Marianna C. Aiello

Issued: May 21, 1996

A training device for entertaining and encouraging a person to sit comfortably for a period of time while toilet training, is the subject of the present invention. The device comprises, a chair member having a seat portion having a central opening therein for the passage of excrement, a back portion attached to the seat portion, and a pair of arms being attached to the seat portion and the back portion also, an electrically powered music box is attached to the chair member for producing a musical tune, an activator for manually activating the music box attached to the chair member, the activator being in electrical communication with the music box and comprising an electrical switch having a music activator button for manually actuating the switch, the button being located on an exterior surface of at least one of the arms. Light emitting diodes are attached to the chair member, the light emitting diodes being in electrical communication with the music box to cause the light emitting diodes to blink to correspond to the musical tune. An on/off switch is attached to the chair member and in electrical communication with the music box to permit control by an adult supervisor.

U.S. Pat. No. 5,781,939

Inventor: Laurita Bledsoe

Issued: Jul. 21, 1998

A potty training chair aid including a training potty including a waste receiving compartment housing having a top opening, a pivotal potty seat, and a potty lid pivotally connected to the training potty with a second pivoting hinge in a manner to be pivotal over the potty seat; a back support extending upwardly from the compartment housing; a pivoting child restraint assembly including an activity tray supported on two lockable support arms, the activity tray including a tray surface having a first plurality of geometric depressions formed therein; a second plurality of geometrically shaped activity blocks; and a cassette tape player mounted within one of the lockable support arms, the cassette tape player having control buttons extending from the support arm at a location accessible to a child seated on the potty seat. In one embodiment an audible reward system including a digital electronic audible message generating circuit having an audible message storage memory, a first pressure activated message activation switch for activating a first message, and a second pressure sensitive message activation switch for activating a second message.

U.S. Pat. No. 6,038,711

Inventor: William A. Clarke

Issued: Mar. 21, 2000

A potty chair resembling a miniature toilet uses features of appearance and a handle for producing a simulated flushing sound, to attract a toddler, familiarize her/him with the device and remove barriers to its usage. A dual phase reward system including a displayable trophy and a storage cubby hole for prizes such as candy, stickers, and toys, encourage the child to use the device and accelerate the completion of potty training.

U.S. Pat. No. 6,282,732

Inventor: Patricia A Krvavica

Issued: Sep. 4, 2001

The toilet flushing handle accessory of the present invention includes a decorative figure attached to an existing toilet flushing handle to customize and decorate a toilet. The toilet flushing handle accessory can include an electronic sound module to provide for recording and playback of audio messages, and a pressurized scented spray canister for providing a scented spray upon each activation of the toilet flushing handle.

U.S. Pat. No. 6,698,036

Inventor: Michael Dean Armbruster, et al.

Issued: Mar. 2, 2004

A potty training device having a seat with an opening for receiving bodily waste, a sensor for sensing bodily waste, and a sensory output generator. The seat includes a retaining member configured and located so as to retain the seat in place with respect to a toilet such that the opening of the seat is located above a bowl of the toilet. The sensor senses the bodily waste that passes through the opening of the seat, and the sensory output generator generates a sensory output in response to the sensor sensing the bodily waste. A potty training device having a seat with an opening for receiving bodily waste and an electronic unit that includes a housing that at least partially contains a sensor for sensing the bodily waste, a power source, and a sensory output generator for outputting a sensory output when the sensor senses the bodily waste. The electronic unit and/or the seat includes a mechanism located and configured to removably couple the electronic unit and the seat such that the sensor is located so as to sense bodily waste received by the opening of the seat.

Swiss Patent Number CH600854

Inventor: Rudolf Moser

Issued: Jun. 30, 1978

Child's potty with sound signal transmitter operated by enclosed battery switch mechanism and temp. sensors to indicate when user has finished.

European Patent Publication Number EP 0 914 793

Inventor: Inkee Chai

Issued: Oct. 28, 1998

A potty for toilet training has a base with a hollow space, a seat with a big hole in its middle and mounted on the base, and receptacle received in the hollow space. Child's condition detecting circuit detects a first condition when a child sits on the seat and begins to relieve him or herself, and a second condition when he or she rises from the seat). Responding to a result of the first condition, a trigger signal generating circuit generates a trigger signal (strig) and stops generation of the trigger signal in response to a result of the second condition. Responding to the trigger signal, a sound/melody generating circuit informs parents that their child begins to relieve himself or herself, generates a natural sound to entertain him or her during evacuation, informs the parents that their child has risen from the seat after stool in response to the stop of the trigger signal (strig), and generates a congratulatory melody or voice message. An aural sound generating circuit amplifies the sounds and message and converts them into audible sounds through a speaker). The potty can provide motivation for the child to go to stool by him or herself.

While these potty training may be suitable for the purposes for which they were designed, they would not be as suitable for the purposes of the present invention, as hereinafter described.

SUMMARY OF THE PRESENT INVENTION

The present invention discloses a potty training device comprised of a housing having a pivotal seat positioned over a cavity for receiving the waste material that is discarded by slidably removing the receptacle that forms the base of the bowl-like cavity. The housing also provides shelf or compartment space for storage of items that can be used by the toddler or child. Also within the housing are the electronic components for recording and playing a musical tune and/or audio clips. Positioned under the seat is a pressure switch that is designed to react to weight placed thereon. The device may also include a switch for engaging and disengaging the pressure switch to prevent the toddler or child from turning the device into a toy. When the pressure switch is engaged a musical tune or prerecorded audio sequence is played for a predetermined period of time or continuously cycled until the switch is opened by the child getting off the seat. Another audio clip of a typical flushing toilet is activated by a handle switch within reach of the toddler or child. Additionally incorporated into the potty training device is an audio recording component whereby the user can selectively record another tune or audio clip to be played when the pressure switch is engaged.

A primary object of the present invention is to provide a potty training device for toddlers and children incorporating elements designed to amuse and overcome their inhibitions.

Another object of the present invention is to provide a potty training device having a housing with a cavity having a pivotal seat attached thereto providing means for engaging a switch when a child sits thereon.

Yet another object of the present invention is to provide a potty training device having a handle for playing an audio clip of a flushing toilet.

Still yet another object of the present invention is to provide a potty training device having shelf and/or compartment space for the storage of books.

Another object of the present invention is to provide a potty training device having a pressure sensitive switch that when activated plays a user selected recording for a predetermined time of cycles until the switch is opened.

Yet another object of the present invention is to provide an audio component providing user's with means for recording other musical tunes and/or audio clips.

Still yet another object of the present invention is to provide a remote receiver incorporating means for indicating whether the seat switch is engaged or disengaged.

Additional objects of the present invention will appear as the description proceeds.

The present invention overcomes the shortcomings of the prior art by providing a potty training device. The device is comprised of a housing having a pivotal seat positioned over a cavity for receiving the waste material, that is discarded by slidably removing the receptacle that forms the base of the bowl-like cavity. The housing also includes shelf or compartment space for storage of items that can be used by the toddler or child. Electronic components are contained within the housing for recording and playing a musical tune and/or audio clips. Located under the seat is a weight sensitive pressure switch comprised of a compressible elastomeric or polymeric material that is shape retentive having the actual switch concealed therein. The device may also include a switch for engaging and disengaging the pressure switch to prevent the toddler or child from turning the device into a toy. When the pressure switch is engaged an audio clip is played. Another audio clip of a typical flushing toilet is activated by depressing a handle positioned on the housing exterior. Also included is an audio recording component for recording another tune or audio clip.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
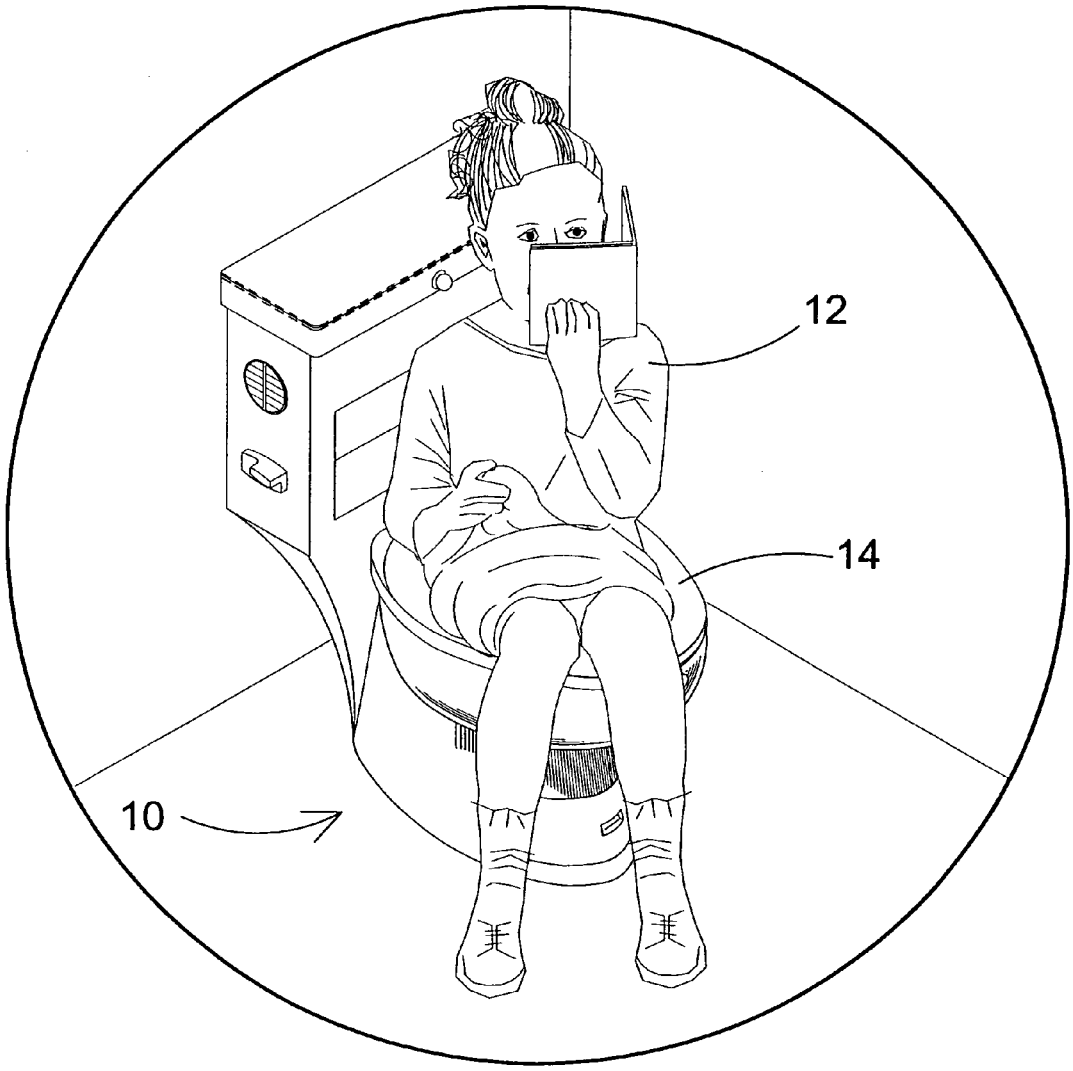
FIG. 1 is an illustrative view of the present invention in use.

With regard to reference numerals used, the following numbering is used throughout the drawings.

10 present invention
12 child
14 seat
16 potty bowl
18 potty receptacle
20 storage box
22 cover handle
24 shelf
26 speaker
28 flush handle
30 pressure switch
32 record switch
34 microphone
36 recording means
38 handle switch
40 EEPROM storage
42 power source
44 processor unit
46 portable receiver
48 clip
50 magnet
52 light emitting diodes
54 transmitter
56 tissue holder
58 decorative tissue
60 housing
62 cavity

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 is a child's 12 potty training device that incorporates a switch that is engaged when the child sits on the seat 14 causing a prerecorded audio sequence to be played. Located within reach of the toddler 12 is a handle that when depressed plays an audio clip of a flushing toilet. The unit 10 also has storage space for keeping reading material, such as books, for the toddler. In addition, the unit 10 has means for selectively recording other tunes or voice messages. The waste receptacle is provided as a removable container that slides in and out from the base of the bowl-like aperture.

Figure 2:
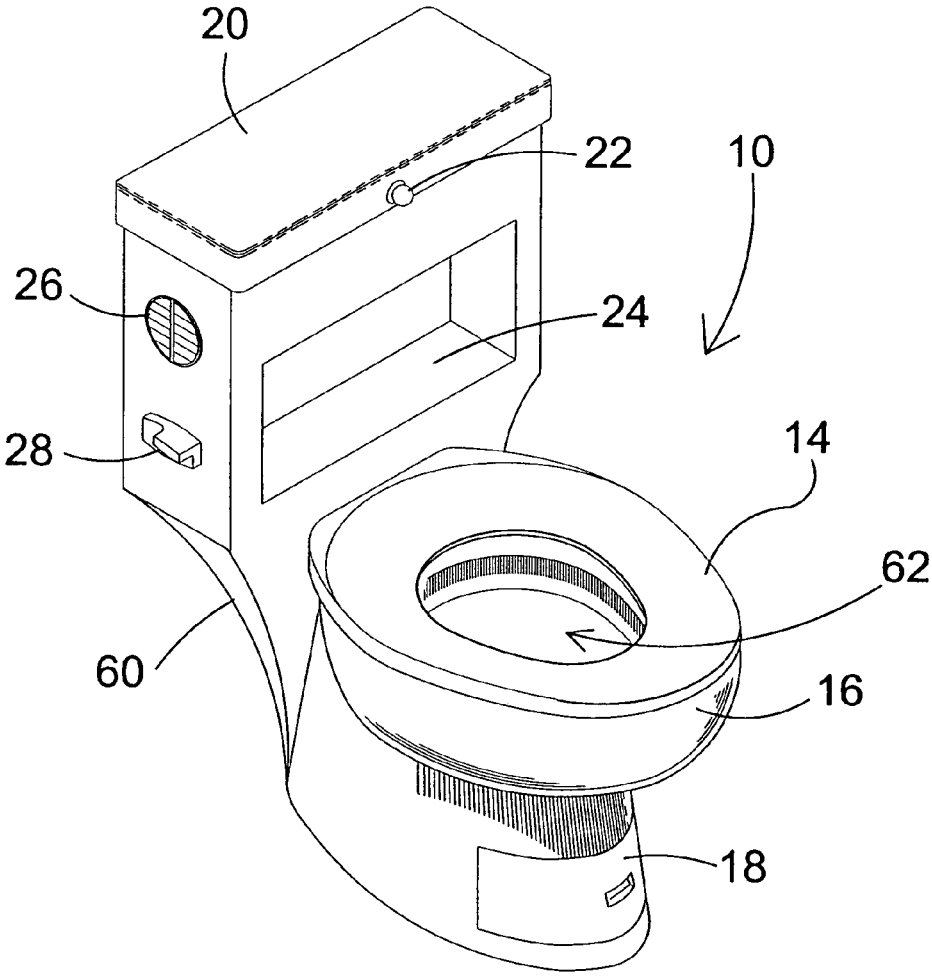
FIG. 2 is a perspective view of the present invention.

Turning to FIG. 2, shown therein is a perspective view of the present invention 10. Shown is the present invention 10 comprising a child's potty training device that is used to familiarize a child or toddler with a conventional toilet. The training device is designed to overcome a child's inhibitions over sitting on a toilet seat 14 where the touch of a handle causes a lot of noise and things placed therein disappear. The portable training device has a housing 60 which has the appearance of a toilet having a front bowl 16 with a cavity therein 62 and rear storage box 20 located where the water tank would be on a conventional toilet with certain features designed to amuse the toddler or child. A pressure switch is positioned under the seat 14 that when closed plays a tune for a predetermined time period or cycles until the child gets up opening the switch. The audio clip can be any prerecorded musical tune or audio clip. A second audio clip of the sound of a typical flushing toilet is provided that can be played by depressing an exteriorly positioned handle. Also shown are potty bowl 16, removable potty tray 18, storage box 20, cover handle 22, shelf 24, speaker 26, and flush handle 28.

Figure 3:
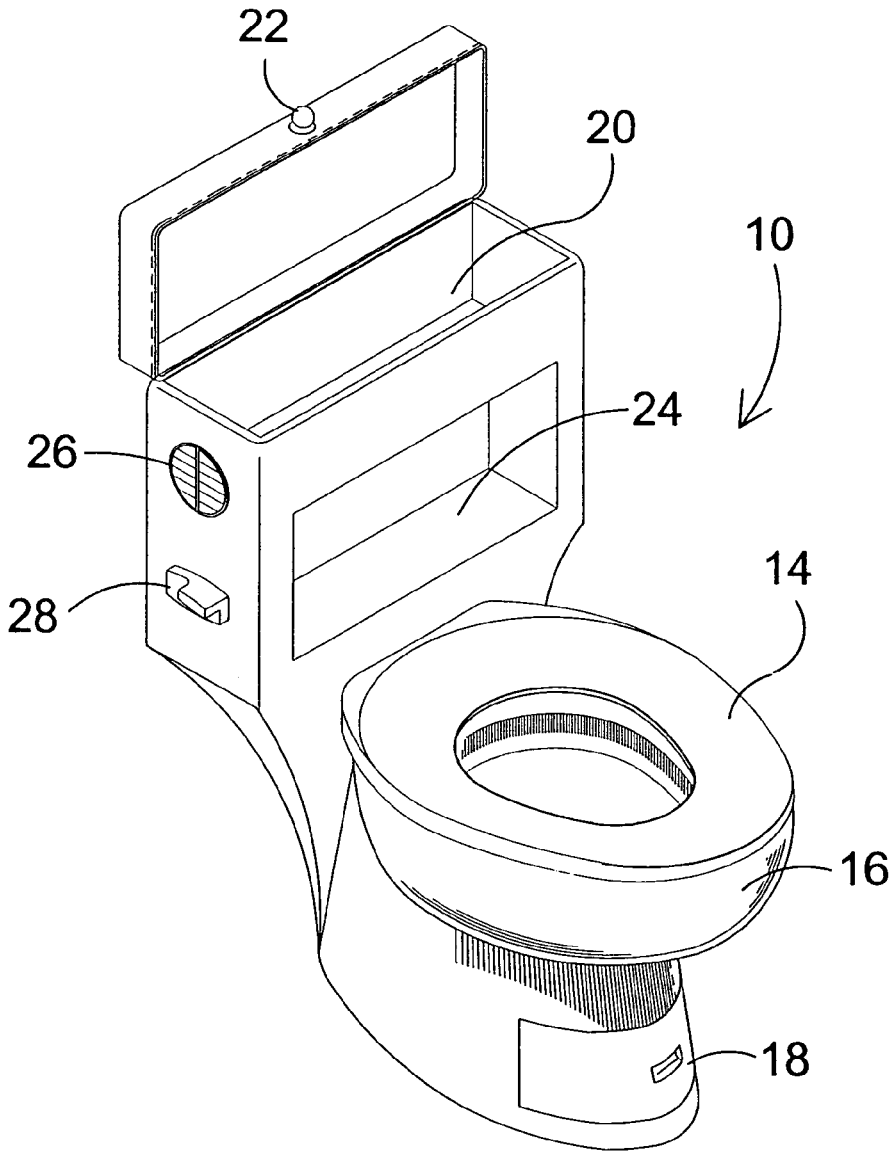
FIG. 3 is a perspective view of the present invention.

Turning to FIG. 3, shown therein is a perspective view of the present invention 10. In addition to the audio features of the potty training device, there is provided a waste receptacle 18 that slides in and out of a cavity forming the bottom of the bowl-like aperture 16. The device 10 includes storage space 20 for books and magazines that can be used by the toddler or child. Other previously disclosed elements are also shown.

Figure 4:
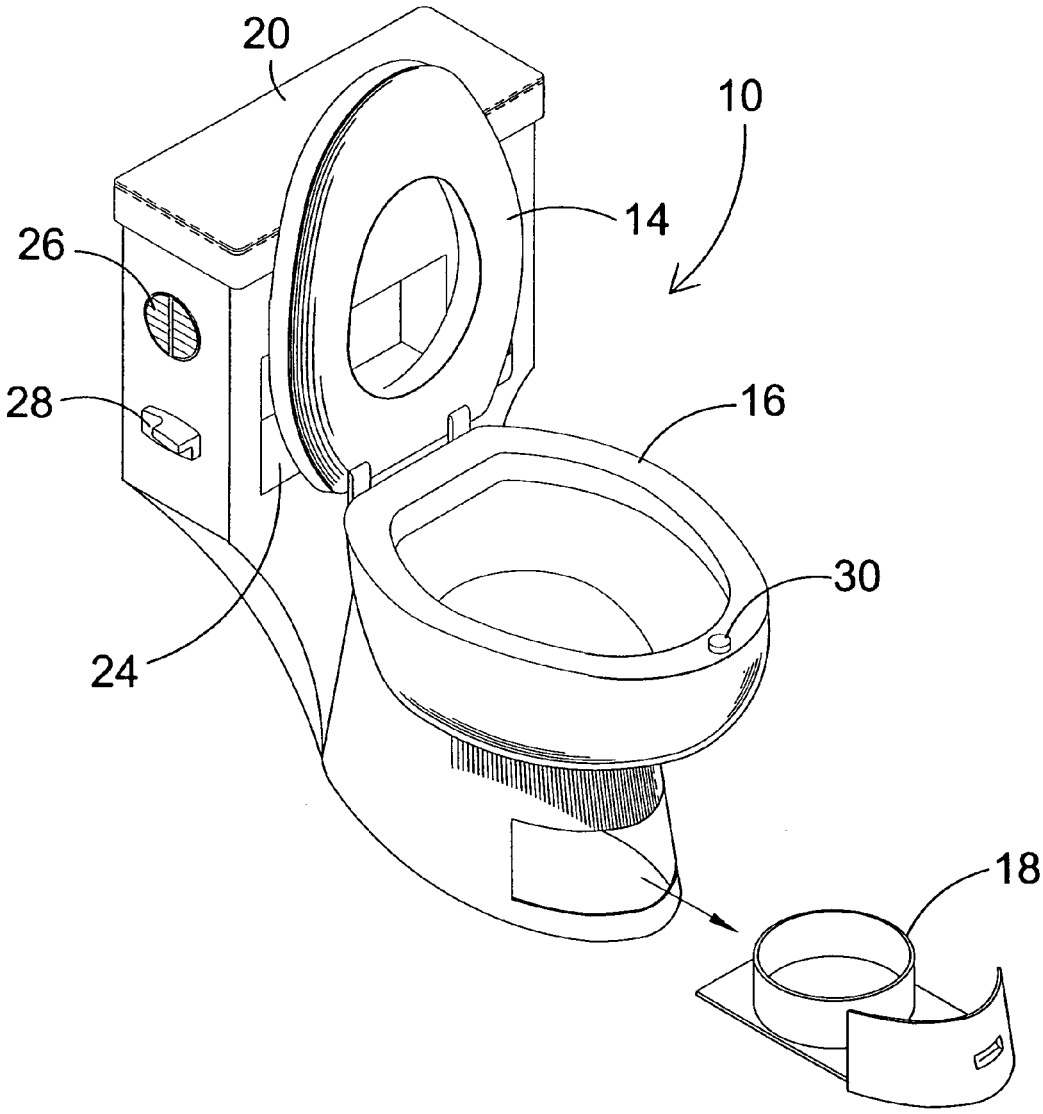
FIG. 4 is a perspective view of the present invention.

Turning to FIG. 4, shown therein is a perspective view of the present invention 10. Shown is the potty training device of the present invention 10 with the pivotal seat 14 in the up position. The device 10 is used to familiarize a child or toddler with a conventional toilet. The device 10 is comprised of a housing having a pivotal seat 14 positioned over a cavity or bowl 16 for receiving the waste material that is discarded by slidably removing the receptacle or tray 18 that forms the base of the bowl-like cavity. The housing also provides shelf 24 or compartment space 20 for storage of items that can be used by the toddler or child. Also within the housing are the electronic components for recording and playing the musical tune and/or audio clips. Positioned under the seat is a pressure switch 30 that when engaged causes a musical tune or prerecorded audio sequence to be played for a predetermined period of time or continuously cycled until the switch is opened by the child getting off of the seat. Another audio clip of a typical flushing toilet is activated by depressing a handle situated within reach of the toddler or child. Also shown are speaker 26 and handle 28.

Figure 5:
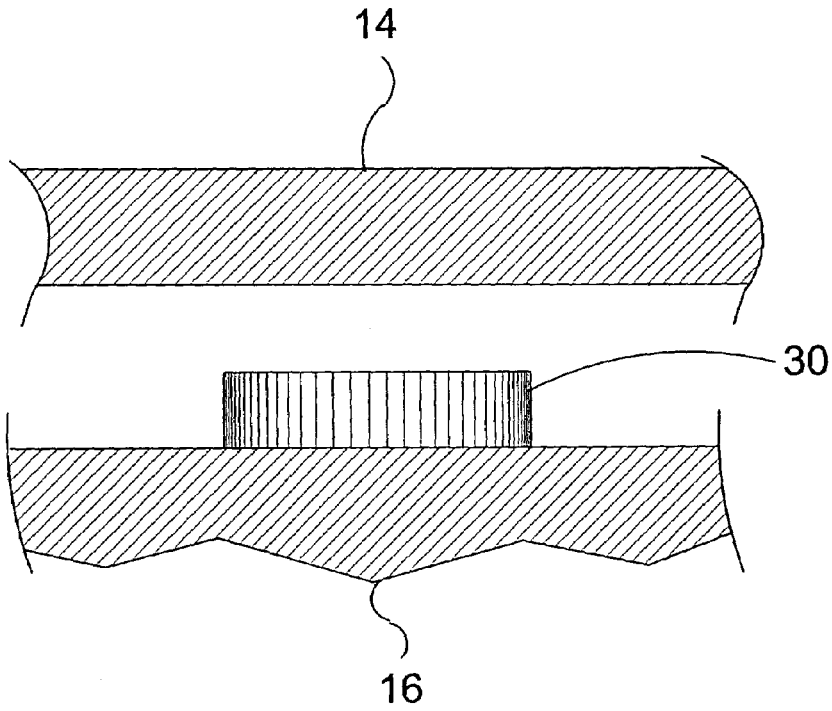
FIG. 5 is a sectional view of the present invention in an open position.

Turning to FIG. 5, shown therein is a sectional view of the present invention in an open position. Positioned within the housing body is a pressure switch 30 located between the bottom of the seat 14 and top of the bowl 16 that engages the playing of an audio clip. The switch 30 is designed to react to weight placed thereon. It can be comprised of a compressible elastomeric or polymeric material that is shape retentive having the actual switch concealed therein protecting the child as well as preventing damage from contact with water, which is inevitable during cleaning. The device 10 may also include a switch for engaging and disengaging the pressure switch 30 to prevent the toddler or child from turning the device into a toy.

Figure 6:
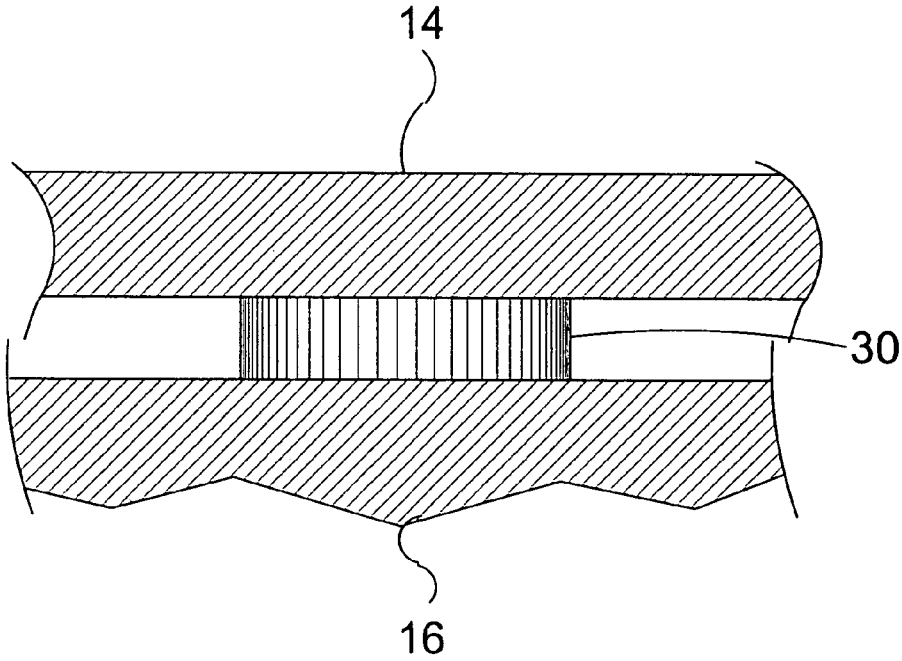
FIG. 6 is a sectional view of the switch in the closed position.

Turning to FIG. 6, shown therein is a sectional view of the switch 30 in the closed position. As previously described, positioned on the bowl 16 within the housing body is a pressure switch 30 that engages the playing of an audio clip. The switch 30 is designed to react to weight of the seat 14 placed thereon. The switch 30 housing can take the form as shown or any desirable shape, such as a dome or recognizable figure such as a musical note comprised of a compressible elastomeric or polymeric material that is shape retentive having the actual switch concealed therein protecting the switch from damage from contact with water, which is inevitable during cleaning. The device 10 may also include a switch for engaging and disengaging the pressure switch 30 to prevent the toddler or child from turning the device into a toy.

Figure 7:
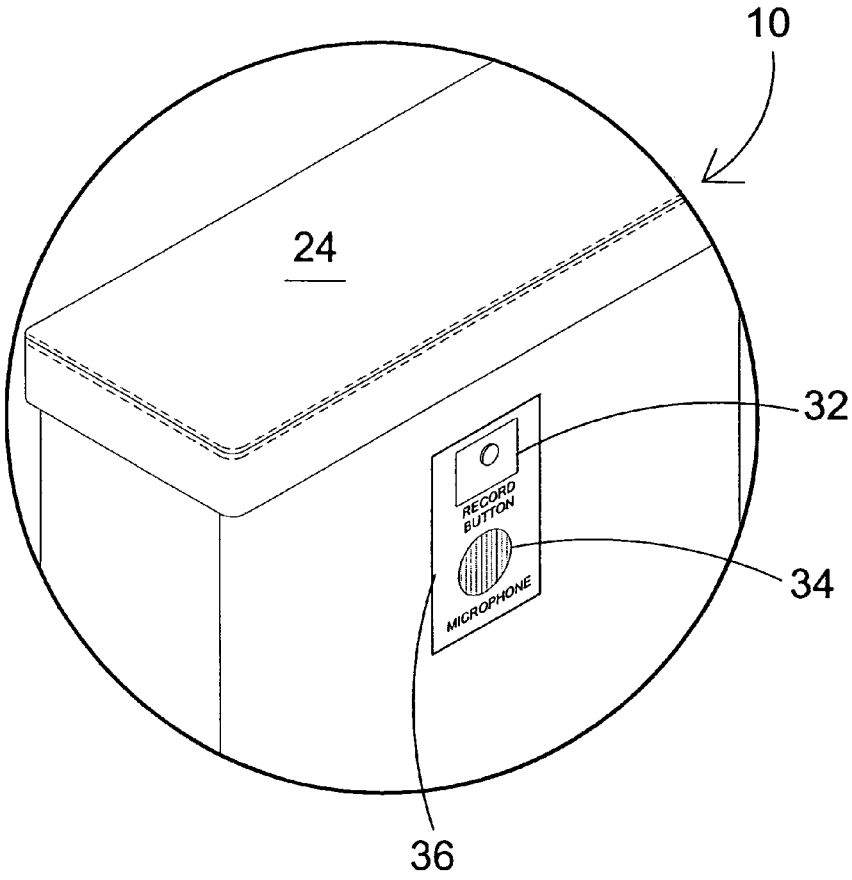
FIG. 7 is a perspective view of the rear portion of the present invention.

Turning to FIG. 7, shown therein is a perspective view of the rear portion of the present invention 10. Shown is the recording means 36 of the present invention 10 positioned on the rear of the storage shelf 24 within the housing comprising a switch 32 and microphone 34 for re-recording a musical tune or audio message. Positioned therein are the electronic components for recording and playing the musical tune and/or audio clips that are activated from a pressure switch located under the seat that engages the playing of the musical tune or prerecorded audio sequence either for a predetermined period of time or continuously cycled until the switch is opened by the child getting off of the seat, whereby the shape retentive switch housing open the switch. Another audio clip of a typical flushing toilet is activated by depressing a handle situated within reach of the toddler or child.

Figure 8:
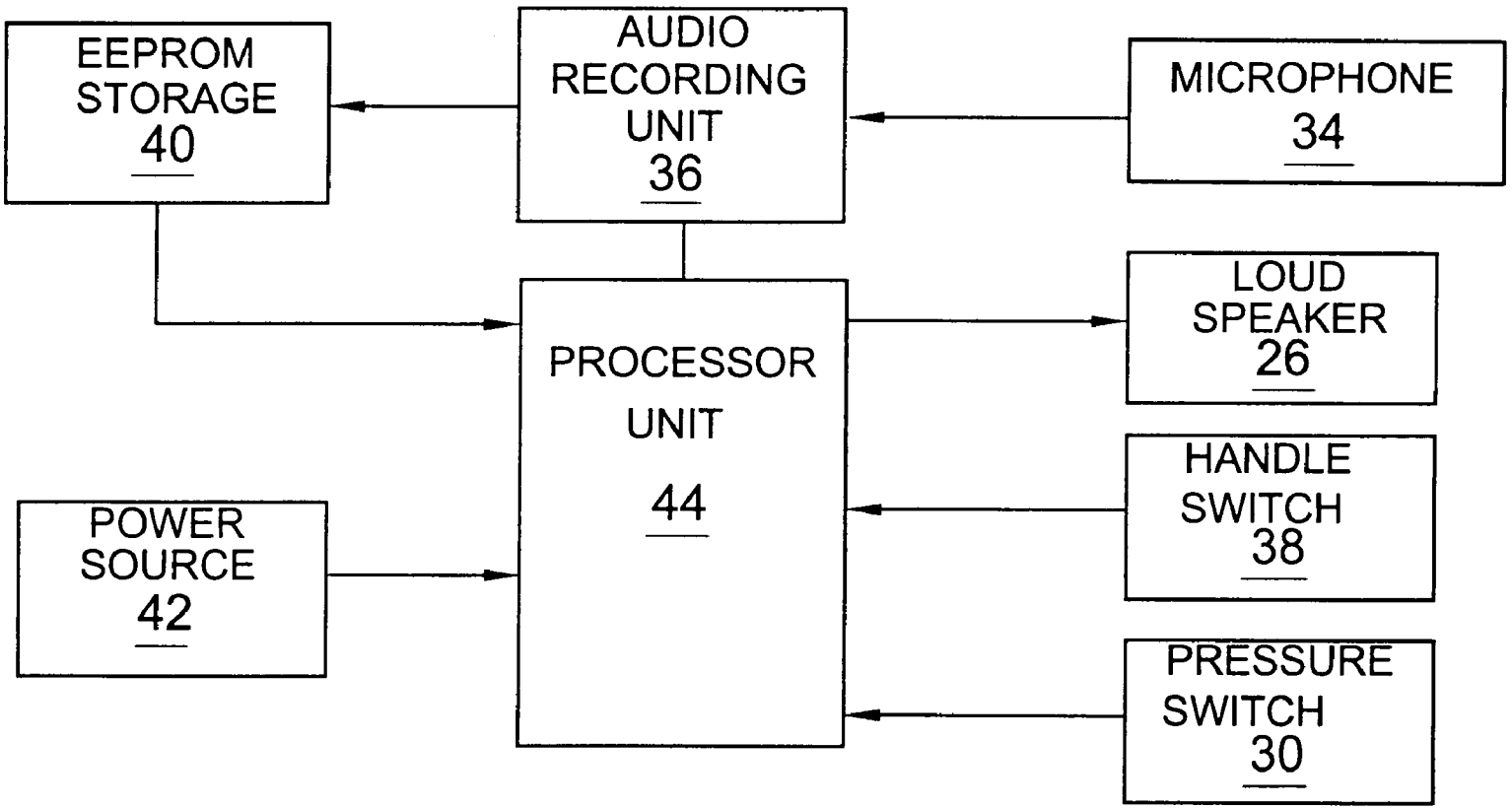
FIG. 8 is a block diagram of the present invention.

Turning to FIG. 8, shown therein is a block diagram of the present invention. Shown is a block diagram of the logic circuit of the present invention comprising means for playing a prerecorded tune or audio clip when the pressure switch 30 is closed and another audio clip that is played when the handle switch 38 is engaged. Also shown is an audio recording component 36 whereby the user can selectively record another tune or audio clip. Also shown are speaker 26, microphone 34, EEPROM (electrically erasable programmable read-only memory) storage 40, power source 42, and processor unit 44.

Figure 9:
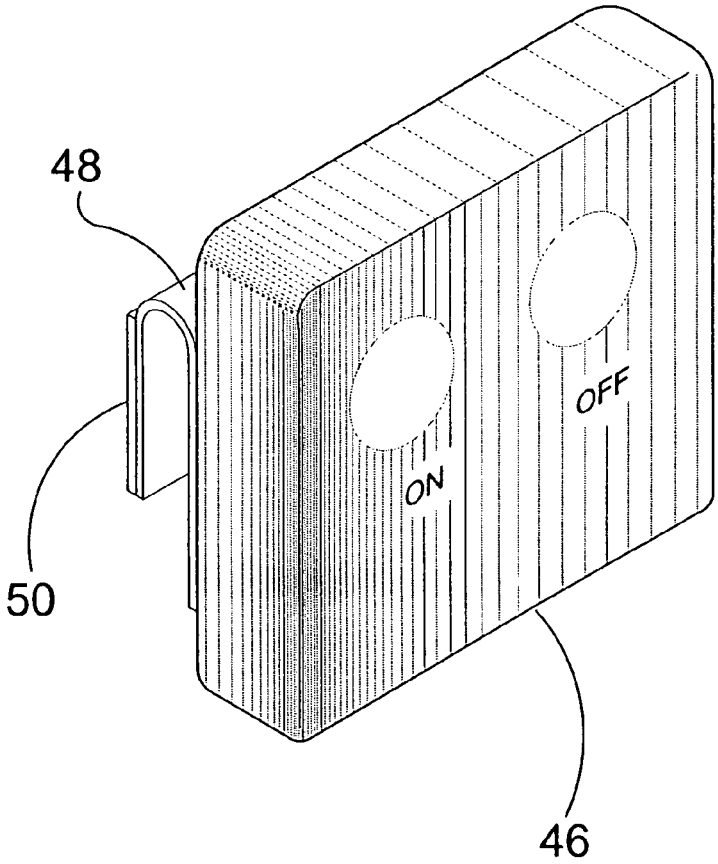
FIG. 9 is a perspective view of an additional element of the present invention.

Turning to FIG. 9, shown therein is a perspective view of an additional element of the present invention. The present invention provides for an additional element in the form of a small portable receiver 46 with on/off controls in communication with the sensor(s) of the potty training device that illuminates when the seat circuit is disrupted by the child rising from the seat. Such a device can remotely monitor whether the child is still on the seat while the parent attends to other pressing matters, such as the phone rings or someone's at the door or any other such chore. The portable receiver 46 has a clip 48 for attachment of the device to an article of clothing in addition to a magnet 50 whereby the device can be attached to the refrigerator until needed.

Figure 10:
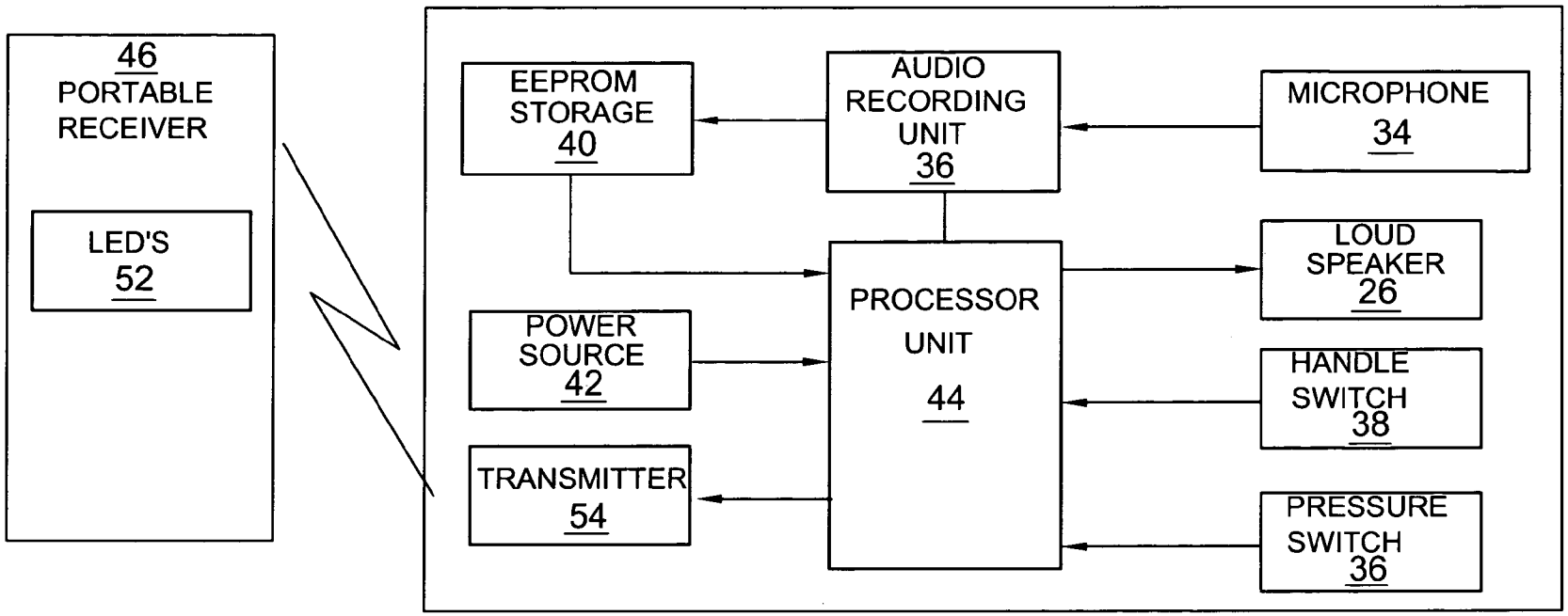
FIG. 10 is a block diagram of the present invention having a portable receiver.

Turning to FIG. 10, shown therein is a block diagram of the present invention having a portable receiver 46 shown in a block diagram of the logic circuit of the present invention with the addition of a portable receiver that will indicate when the toddler or child gets off of the seat. The circuit also comprises means for playing a prerecorded tune or audio clip when the pressure switch 30 is closed and another audio clip that is played when the handle switch is engaged. Also shown is an audio recording component 36 whereby the user can selectively record another tune or audio clip. Also shown are light emitting diodes 52 and transmitter 54 and other previously disclosed elements.

Figure 11:
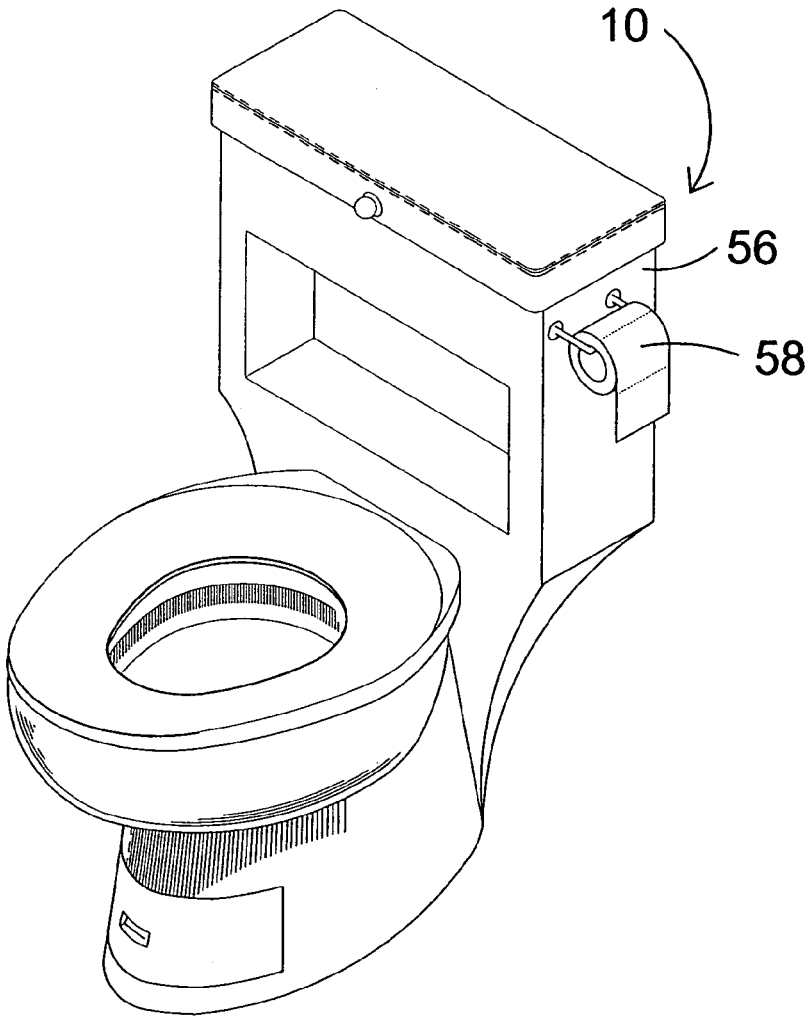
FIG. 11 is a perspective view of the present invention with an additional element.

Turning to FIG. 11, shown therein is a perspective view of the present invention 10 having an additional element. The present invention 10 is also provided with a regular sized toilet tissue holder 56 and rolls of decorative tissue 58. The toilet tissue 58 of the present invention 10 may be available in a great variety of styles to enhance the potty training experience wherein one roll will have each sheet in a different color and another may have a rainbow imprint running throughout the roll. Cartoon characters, animals and other such designs may also be utilized.

I claim:

1. An apparatus for potty training a child, comprising:

a) a housing having a front and rear portion, wherein a potty bowl having a top and bottom portion is disposed on said front of said housing, said potty bowl having a cavity therein to permit the child to potty therein;

b) a seat being disposed on said top of said potty bowl to permit the child to sit thereon while the child potties, said seat having top and bottom sides, a front and a rear, wherein said seat is pivotally attached at its rear to said housing to permit the seat to pivot up and down on the potty bowl;

c) a removable potty receptacle being disposed in said bottom of said potty bowl for receiving potty waste from the child;

d) a storage box being disposed on said rear of said housing to permit articles to be placed therein, said storage box having a front and rear side, a top, and first and second sides;

e) first electrical components for recording and playing a plurality of audio outputs being disposed in said housing;

f) a first switch being disposed between said top of said potty bowl and said bottom of said seat, wherein said first switch activates said first electrical components when the child sits on said seat to permit the first electrical components to play a first audio output when the child sits on the seat to assist the child in becoming potty trained;

g) a shelf being disposed on said front of said storage box; and, wherein said housing is shaped substantially like a toilet, the toilet having a bowl, a seat and a water tank, said storage tank being disposed substantially where a water tank would be disposed on a toilet.

2. The apparatus of claim 1, wherein said first switch is a pressure switch, wherein said pressure switch is waterproof.

3. The apparatus of claim 2, further comprising a simulated flush handle being disposed on said housing within reach of the child sitting on said seat.

4. The apparatus of claim 3, further comprising an on/off switch for turning off said first switch to permit the first switch to be deactivated.

5. The apparatus of claim 4, further comprising second electrical components for recording an audio output to be played by said first electrical components.

6. The apparatus of claim 5, wherein said second electrical components are disposed on said storage box, wherein said second electrical components comprise a record button for controlling of said second electrical components and a microphone for generating an input signal thereto.

7. The apparatus of claim 6, wherein a second audio output is played by said first electrical components when said flush handle is moved by the child.

8. The apparatus of claim 7, further comprising a portable monitor for being worn by a person for monitoring when the child gets off of said seat to indicate that the child has ceased to potty.

9. The apparatus of claim 8, wherein said first electrical components for recording and playing a plurality of audio outputs, comprises:

a) a microprocessor for controlling said first electrical components;

b) an audio recording unit for recording and playing a plurality of audio outputs;

c) a microphone for providing an audio input to said audio recording unit;

d) a loudspeaker for receiving an audio output signal from said microprocessor; and, e) an electrically erasable programmable read-only memory storage device for receiving data from said audio recording unit and transmitting data to said microprocessor.

10. The apparatus of claim 9, wherein said portable monitor, comprises:

a) a transmitter for receiving a signal from said microprocessor indicating that the child has gotten off of said seat and for transmitting a signal;

b) a receiver for receiving a signal from said transmitter; and, c) an illumination device that illuminates when the child has gotten off of said seat.

11. The apparatus of claim 10, further comprising a toilet paper holder being disposed on said storage box, and, decorative toilet paper being disposed on said toilet paper holder.

12. The apparatus of claim 11, wherein said receptacle is slidable in and out of said potty bowl.

13. The apparatus of claim 12, further comprising a handle being disposed on said top of said storage box for opening the top of the storage box.

* * * * *